US005970299A

United States Patent [19]

Sano et al.

[11] Patent Number: 5,970,299

[45] Date of Patent: Oct. 19, 1999

[54] IMAGE HEATING APPARATUS

[75] Inventors: Tetsuya Sano, Numazu; Koichi Tanigawa, Mishima; Hideo Nanataki, Tokyo; Atsuyoshi Abe, Susono, all of Japan

[73] Assignee: Canon Kabushiki Kaisha, Tokyo, Japan

[21] Appl. No.: 09/032,941

[22] Filed: Mar. 2, 1998

[30] Foreign Application Priority Data

Feb. 28, 1997 [JP] Japan ..... 9-062241

[51] Int. Cl.[6] ..... G03G 15/20

[52] U.S. Cl. ..... 399/330; 219/619; 399/328

[58] Field of Search ..... 399/328, 329, 399/330, 335; 219/619, 671, 216

[56] References Cited

U.S. PATENT DOCUMENTS

| | | | |
|---|---|---|---|
| 5,745,833 | 4/1998 | Abe et al. | 399/330 |
| 5,778,293 | 7/1998 | Ohtsuka | 399/329 |
| 5,819,150 | 10/1998 | Hayasaki et al. | 399/330 |
| 5,839,043 | 11/1998 | Okabayashi et al. | 399/329 |
| 5,881,349 | 3/1999 | Nanataki et al. | 399/328 |

FOREIGN PATENT DOCUMENTS 0 649 072 4/1995 European Pat. Off. .

*Primary Examiner*—Matthew S. Smith
*Attorney, Agent, or Firm*—Fitzpatrick, Cella, Harper & Scinto

[57] ABSTRACT

An image heating device includes a movable member including an electroconductive layer; an excitation coil for generating magnetic flux; wherein the magnetic flux generated by the excitation coil generates an eddy current which in turn generates heat in the movable member to heat an image on a recording material; and a magnetic member for guiding the magnetic flux; wherein the magnetic member is elongated in a direction perpendicular to a movement direction of the movable member, and the excitation coil is extended in a longitudinal direction of the magnetic member; wherein the magnetic member including a first magnetic portion adjacent to the movable member, a second magnetic portion, and a third magnetic portion between the first magnetic portion and the second magnetic portion and adjacent to the movable member with the excitation coil therebetween, as seen in the longitudinal direction.

30 Claims, 16 Drawing Sheets

(a)

(b)

(c)

(a)

(b)

IMAGE HEATING APPARATUS

FIELD OF THE INVENTION AND RELATED ART

The present invention relates to an image heating device usable with an image forming apparatus such as a copying machine or a printer, more particularly to an apparatus for heating images by heat generated by electromagnetic induction.

Conventionally, a heat roller type fixing device is widely used, as an image heating device for effecting heating and fixing of an unfixed toner image on a recording material usable with an image forming apparatus such as a copying machine or a printer.

The fixing device in the form of a heat roller type heating apparatus comprises as fundamental elements a fixing roller (heating roller) and a pressing roller(press-contact roller pair), and the roller pair is rotated. A recording material on which unfixed image is formed is passed through a fixing (heating) nip formed between the rollers, so that unfixed image is fixed by the heat from the fixing roller and the pressure by the nip, on the recording material.

The fixing roller generally comprises a hollow metal roller of aluminum as a base(core metal), and a halogen lamp therein as a heat source. It is heated by the heat generation of the halogen lamp. The electric energization to the halogen lamp is controlled so as to maintain the outer surface at a predetermined fixing temperature.

Japanese Utility Model Application No. SHO-51-109737 discloses an electromagnetic induction heating fixing device wherein heat generation is effected by joule heat generated by induction of current in the fixing roller using magnetic flux. According to this type, the heat is generated directly by the fixing roller using heat induced current. The efficiency of the fixing process is higher than the heat roller type fixing device using the halogen lamp as the heat source.

However, although the electromagnetic induction heat fixing device as disclosed in Japanese Utility Model Application No. SHO-51-109737 permits a higher efficiency than the heat roller type, a radiation heat loss is relatively larger since the energy of the alternating magnetic flux generated by an excitation coil as the magnetic field generating means is used for raising the temperature of the entire fixing roller, and therefore, the density of the fixing energy relative to the supplied energy is low.

Therefore, proposals have been made to increase the efficiency, for example, the use is made with a film in place of the fixing roller to reduce the entirety thermal capacity, or the excitation coil is placed closer to the film to gain the energy for the fixing at a high density, or the alternating magnetic flux distribution of the excitation coil is concentrated to the neighborhood of the fixing nip.

With respect to the above-described electromagnetic induction heating type fixing device, when the operation speed is to be increased, a larger electric power is required since the fixing quality should be maintained. Then, the heating value is increased, but from the standpoint of self heat generation of the excitation coil, the electric power which can be supplied is not limitless, and therefore, the speed-up using the control of the amount of the electric power has a limit.

Additionally, when the coil is formed into a configuration along the fixing roller(or fixing film), variations in the configuration of the coil and the positional relation between the coil and the film results in variation of the coil property and therefore in the low efficiency.

SUMMARY OF THE INVENTION

Accordingly, it is a principal object of the present invention to provide an image heating device of an electromagnetic induction type having a high heating efficiency.

According to an aspect of the present invention, there is provided an image heating device includes a movable member including an electroconductive layer; an excitation coil for generating magnetic flux; wherein the magnetic flux generated by the excitation coil generates an eddy current which in turn generates heat in the movable member to heat an image on a recording material; and a magnetic member for guiding the magnetic flux; wherein the magnetic member is elongated in a direction perpendicular to a movement direction of the movable member, and the excitation coil is extended in a longitudinal direction of the magnetic member; wherein the magnetic member including a first magnetic portion adjacent to the movable member, a second magnetic portion, and a third magnetic portion between the first magnetic portion and the second magnetic portion and adjacent to the movable member with the excitation coil therebetween, as seen in the longitudinal direction.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described.

Figure 18:
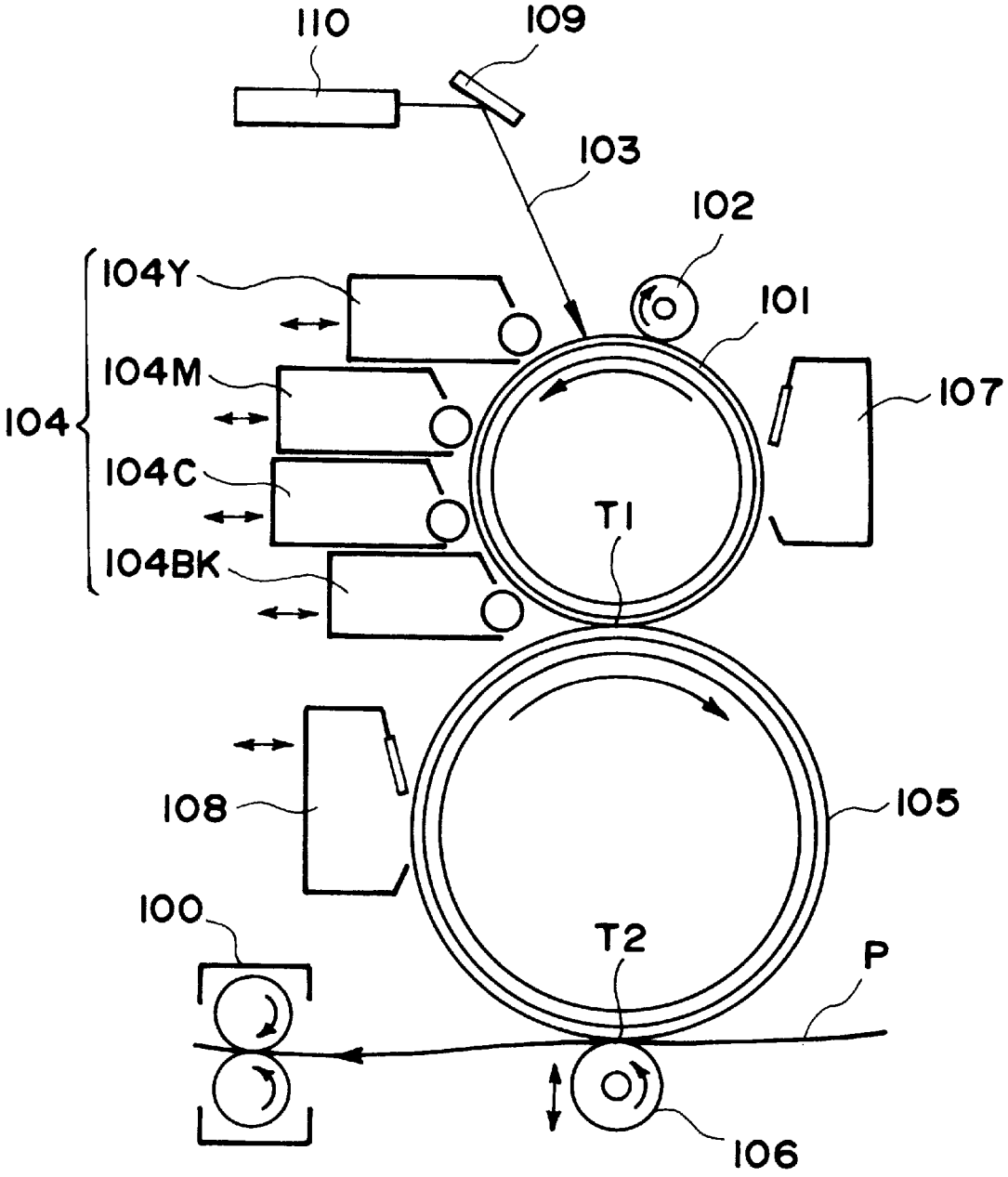
FIG. 18 is a schematic view of an image forming apparatus according to an embodiment of the present invention.

FIG. 18 is a schematic illustration of an example of an image forming apparatus using an image heating device according to an embodiment of the present invention. In this embodiment, the image forming apparatus is in the form of an electrophotographic color printer.

Designated by 101 is an electrophotographic photosensitive drum(image bearing member) of organic photosensitive member or amorphous silicon photosensitive material, and is rotated in the counterclockwise direction indicated by the arrow at a predetermined process speed(peripheral speed).

During rotation, the photosensitive drum 101 is uniformly charged to a predetermined potential of a predetermined polarity by the charging device 102 such as a charging roller.

Then, the charged surface is subjected to a laser beam 103 outputted from a laser optical system casing(laser scanner) 110 as an exposure device. The laser optical system 110 outputs a laser beam 103 which is modulated (ON/Off) in accordance with the time series electrical digital pixel signals representative of intended image information from an image signal generating device such as an unshown image reading apparatus, and the surface of the rotatable photosensitive drum 101 is scanned by and exposed to the scanning laser beam, so that electrostatic latent image is formed in accordance with the intended image information. Designated by 109 is a mirror for deflecting the emitted laser beam from the laser optical system 110 to the exposure position of the photosensitive drum 101

In the case of a full-color image formation, the scanning exposure and the latent image formation is carried out for a first color-separated component image, for example, a yellow component image of the intended full-color image, and the latent image thus formed is developed into a yellow toner image by a yellow developing device 104Y of the four-color development apparatus 104. The yellow toner image is transfer on the surface of an intermediary transfer drum 105 at a primary transfer portion T1 where the photosensitive drum 101 and an intermediary transfer drum (transferring device) 105 are contacted or in close proximity with each other. The surface of the rotatable photosensitive drum 101 after the toner image transfer onto the surface of the intermediary transfer drum 105, is cleaned by a cleaner 107 so that residual toner or other deposited residual are removed.

The process cycle including the charging, the scanning exposure, the development, the primary transfer and the cleaning is sequentially repeated for the second color-separated component image of the full-color image, for example, the magenta component image(magenta developing device 104M), and the third color component image (cyan component image; cyan developing device 104C is used), and the fourth color component image(black component image: the black-color developing device 104BK is operated), and the yellow toner image, the magenta toner image, the cyan toner image and black toner image toner images are sequentially transferred superimposedly onto the intermediary transfer drum 105, so that color toner image is formed corresponding to the full-color image.

The intermediary transfer drum 105 comprises a metal drum, an elastic layer having an intermediate resistance, and a surface layer having a high resistance.

The color toner image on the surface of the intermediary transfer drum 105, is transferred, at a secondary transfer portion T2 in the form of a contact nip between the rotatable intermediary transfer drum 105 and a transfer roller (transferring device) 106 onto a surface of a recording material P fed at the predetermined timing from an unshown sheet feeder to the secondary transfer portion T2. The transfer roller 106 transfers the color toner images all together from the intermediary transfer drum 105 onto the recording material P by supplying, to the back surface of the recording material P, the charge having the polarity opposite from that of the toner.

The recording material P having passed through the secondary transfer portion T2, is separated from the surface of the intermediary transfer drum 105, and is introduced to an image heating device(fixing device) 100, where the unfixed toner image is fixed by heat, and it is discharged onto an unshown sheet discharge tray outside the machine.

The rotatable intermediary transfer drum 105 is cleaned, after the color toner image transfer onto the recording material P, by a cleaner 108 so that residual toner the paper dust or other deposited residual are removed therefrom. The cleaner 108 is normally kept out of contact from the intermediary transfer drum 105, and is brought into contact to the intermediary transfer drum 105 upon the secondary transfer execution process of the color toner image onto the recording material P from the intermediary transfer drum 105.

Also, the transfer roller 106 is kept out of contact from the intermediary transfer drum 105, and is moved toward the intermediary transfer drum 105 with the recording material P therebetween in the secondary transfer execution process of the color toner image from the intermediary transfer drum 105 onto the recording material P.

Thus, in the image forming apparatus of this example, an image forming means for forming an unfixed toner image on the recording material, comprises the electrophotographic photosensitive drum (image bearing member) 101 as a member to be charged, the charging roller (charging device) 102 for charging the electrophotographic photosensitive drum 101, the exposure device 110 for forming an electrostatic latent image by exposure of the electrophotographic photosensitive drum 101, the developing device 104 for forming the toner image by deposition of the toner; on the electrostatic latent image, and the transferring device 105, 106 for transferring the toner image from the electrophotographic photosensitive drum 101 onto the recording material P as the transfer material.

The image forming apparatus in this example is operable in a monochromatic mode to form a monochromatic image such as a black and white image. Additionally, it is operable in a both-sided image printing mode or a superimposing print mode.

In the case of the both-sided image printing mode, the recording material P having a first image and discharged from the image heating device 100 is fed to a secondary transfer portion T2 through an unshown recirculation feeding mechanism after its face orientation is reversed, and is subjected to a toner image transfer onto the second face, and is then introduced into an image heating device 100, so that both-sided image print is produced.

In the superimposing print mode, the recording material P having an image formed on the first face and discharged from the image heating device 100 is fed to a secondary transfer portion T2 through an unshown re-circulation feeding mechanism without its facing orientation being reversed, and it receives a second toner image transfer member onto the same face, and is then introduced into the image heating device 100, so that superimposing print is produced.

The description will be made as to the image heating device of this embodiment.

In this embodiment, the heating apparatus is a heat-fixing device of an electromagnetic induction heating type. The heat-fixing device is an electromagnetic induction heating type and a pressing roller driving type using a cylindrical belt as the electromagnetic induction heat generation property member.

Figure 1:
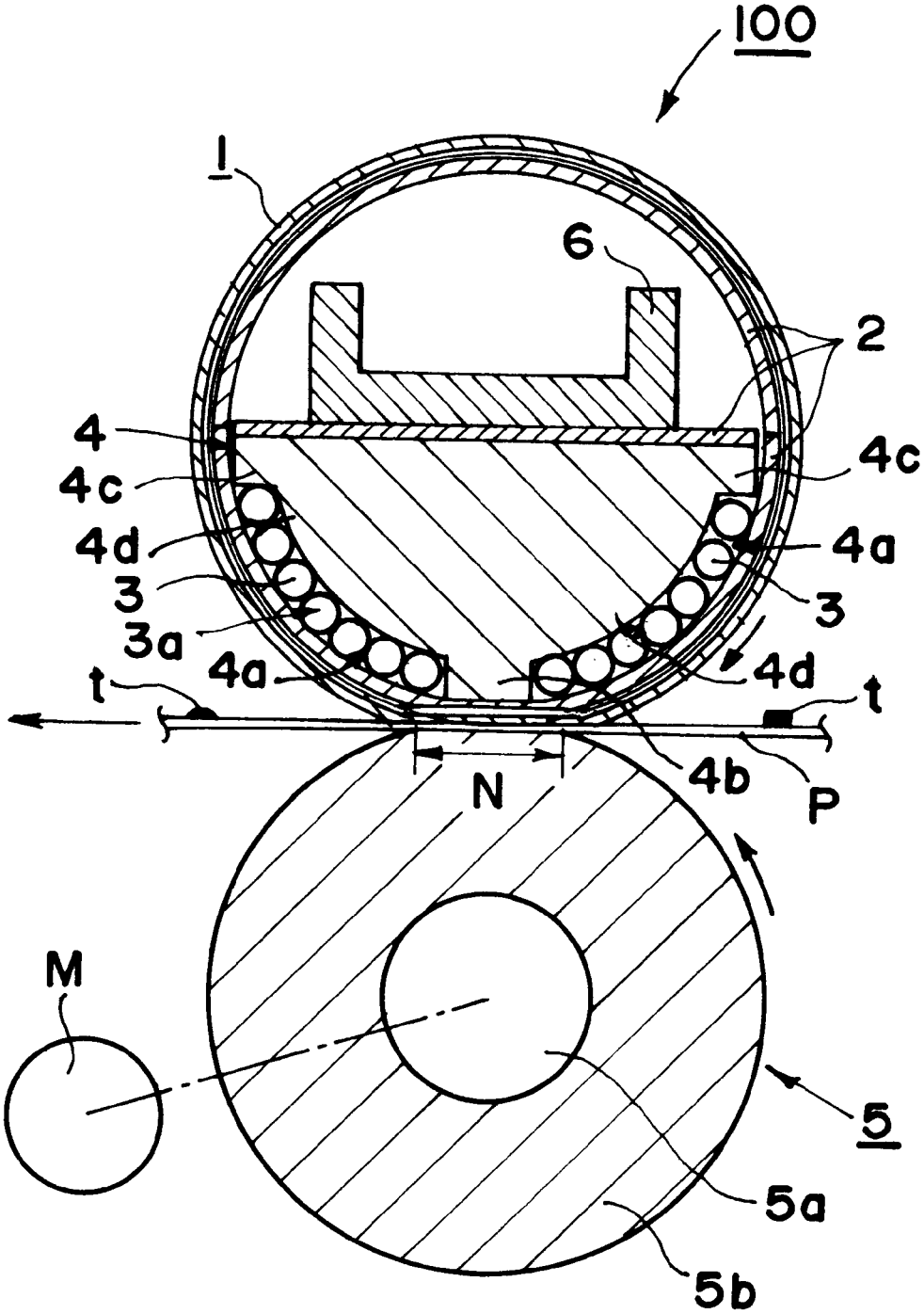
FIG. 1 is a sectional view of an image heating device according to an embodiment of the present invention.
Figure 2:
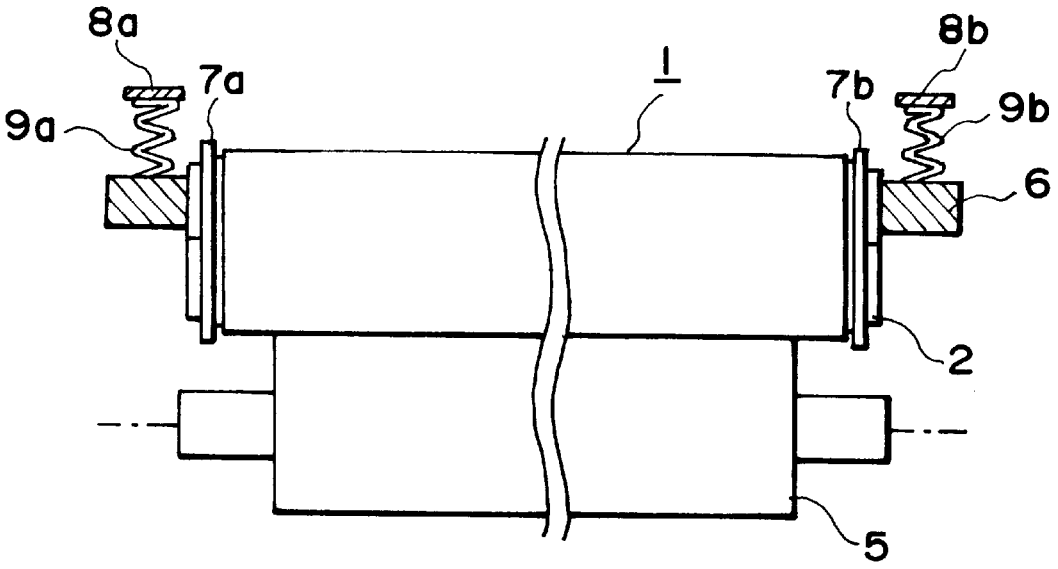
FIG. 2 is a front view of the image heating device.
Figure 3:
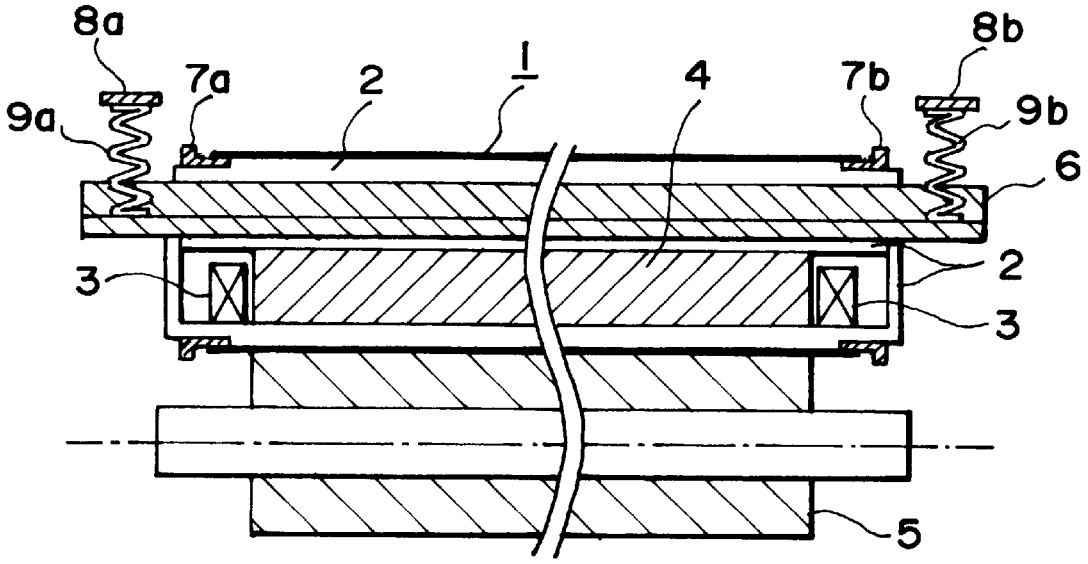
FIG. 3 is a sectional view of the apparatus shown in FIG. 2.

FIG. 1 is a schematic cross-sectional view of a major part of the heat-fixing device as seen in the longitudinal direction of the magnetic member, and FIG. 2 is a schematic front view of a major part of the same apparatus, FIG. 3 is a longitudinal section view of a major part of the same apparatus.

The heat-fixing device 100 of this example comprises a rotatable member in the form of an electromagnetic induction heat generation member, namely, a fixing film 1 in the form of a cylindrical electromagnetic induction heat generation film as the endless belt, a film guiding member 2, a magnetic core(core material) 4 and an excitation coil 3 as the magnetic field generating means, and a pressing roller 5 as a pressing member. The recording material P carrying the unfixed toner image t is introduced into the fixing nip N formed by the fixing film 1 and the pressing roller 5 contacted to each other, and the recording material P is heated by electromagnetic induction heat generation of the fixing film 1 while being pressed, so that unfixed toner image t is fused and fixed on the surface of the recording material P.

Figure 4:
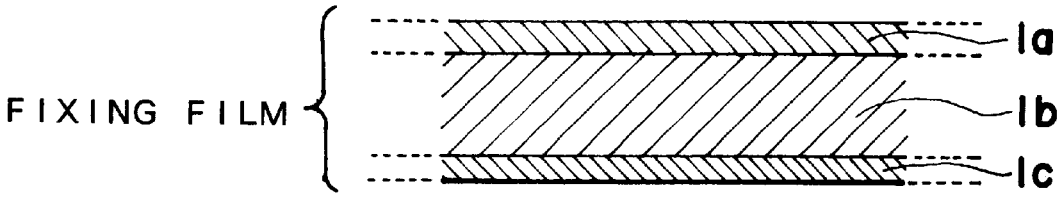
FIG. 4 shows a layer structure of the film.

As shown in FIG. 4, the fixing film 1 which is a movable electromagnetic induction heat generation property film, has a multi-layer structure comprising a base layer or heat generation layer 1*a* of metal film(electroconductive layer), and an elastic layer 1*b* laminated outside thereof, and a parting layer 1*c* laminated outside thereof.

The heat generation layer 1*a* is preferably of ferromagnetic metal such as nickel, iron, ferromagnetic SUS, nickel-cobalt alloy, and preferably has a thickness of 1–100 μm from the standpoint of the absorption efficiency of electromagnetic energy and the rigidity of the film.

The elastic layer 1*b* functions to permit the heating surface(parting layer 1*c*) to follow the unsmoothness of the recording material P or the unsmoothness due to the unfixed toner image t thus preventing uneven glossiness as in color image fixing or the like; it is preferably of silicone rubber, fluorine rubber, fluorosilicone rubber or other materials having high heat-resistivity and thermal conductivity; and it preferably has a thickness of 10–500 μm and a hardness of 60° (JIS-A) or lower.

The parting layer 1*c* is of a fluorine resin material, silicone resin material, fluorosilicone rubber, fluorine rubber, silicone rubber, PFA, PTFE, FEP or the like having a thickness of 1–100 μm and a high parting property and heat resistivity.

In this example, the inside of the heat generation layer 1*a* is provided with a heat insulation layer of heat resistive resin material such as fluorine resin material, polyimide resin material, polyamide resin material, PEEK, resin material, PES, resin material, PPS, resin material, PFA, resin material, PTFE, resin material, FEP, resin material or the like, so that heat supply efficiency to the recording material P is further increased.

From the standpoint of insulative property assurance relative to the excitation coil 3 and the fixing film 1, the film guiding member 2 is of a material having a high insulative property and heat resistivity, such as phenolic resin, polyimide resin material, polyamide resin material, polyamide-imide resin material, PEEK, resin material, PES, resin material, PPS, resin material, PFA, resin material, PTFE, resin material, FEP, resin material. LCP, resin material or the like, and it functions for pressing to the pressing roller 5 at the press-contact portion(fixing nip N), for supporting the magnetic core 4 and the excitation coil 3 as the magnetic field generating means, for supporting the fixing film 1 and for stabilizing the movement of the fixing film 1.

The magnetic core 4 of a magnetic material is a high magnetic permeability core having a semicircular cross-section, and is of a material used for a core of a transformer such as ferrite, permalloy or the like (preferably ferrite material exhibiting small loss at a core or higher). The magnetic core 4 is provided with an arc-like recess 4*a* at each of the sides of the fixing nip N substantially equidistantly therefrom (upstream and downstream with respect to the movement direction of the fixing film 1) to maintain the configuration of the excitation coil 3 in conformity with the inner surface of the fixing film 1.

In other words, the magnetic core 4 has a first magnetic portion 4*b* and a second magnetic portion 4*c* in the form of projections adjacent to the film 1, and a third magnetic portion 4*d* between the first magnetic portion 4*b* and the second magnetic portion 4*c*, wherein the third magnetic portion 4*d* is lower than the first magnetic portion 4*b* and the second magnetic portion 4*c* so as to provide a recess 4*a*. The third magnetic portion 4*d* is arcuated convex outwardly (curved surface), and is close to the film 1 with the excitation coil therebetween.

The excitation coil 3 as the magnetic flux generating means includes a bundle 3*a* of a plurality of copper lines each coated with insulating material, is wound around the magnetic core 4 a plurality of turns along the inner surface of the fixing film 1 in the recess 4*a* of the magnetic core 4, thus forming a coil, and lead lines therefrom are connected to an unshown excitation circuit. The insulation coating of excitation coil 3 is, in this example, of a heat resistive polyimide, and the number of windings is seven. The diameter of the lines and the cross-sectional area of the bundle or the like are determined on the basis of the current through the excitation coil 3, and in this example, 98 lines each having a diameter of 0.2 mm (cross-sectional area of the bundle is approx. 3.1 $mm^2$), are used. As described hereinbefore, the excitation coil 3 around the magnetic core 4 continuously extends over the width, namely, in the direction perpendicular to the movement direction of the fixing film 1 (in the direction of the axis of the fixing film 1).

Figure 5:
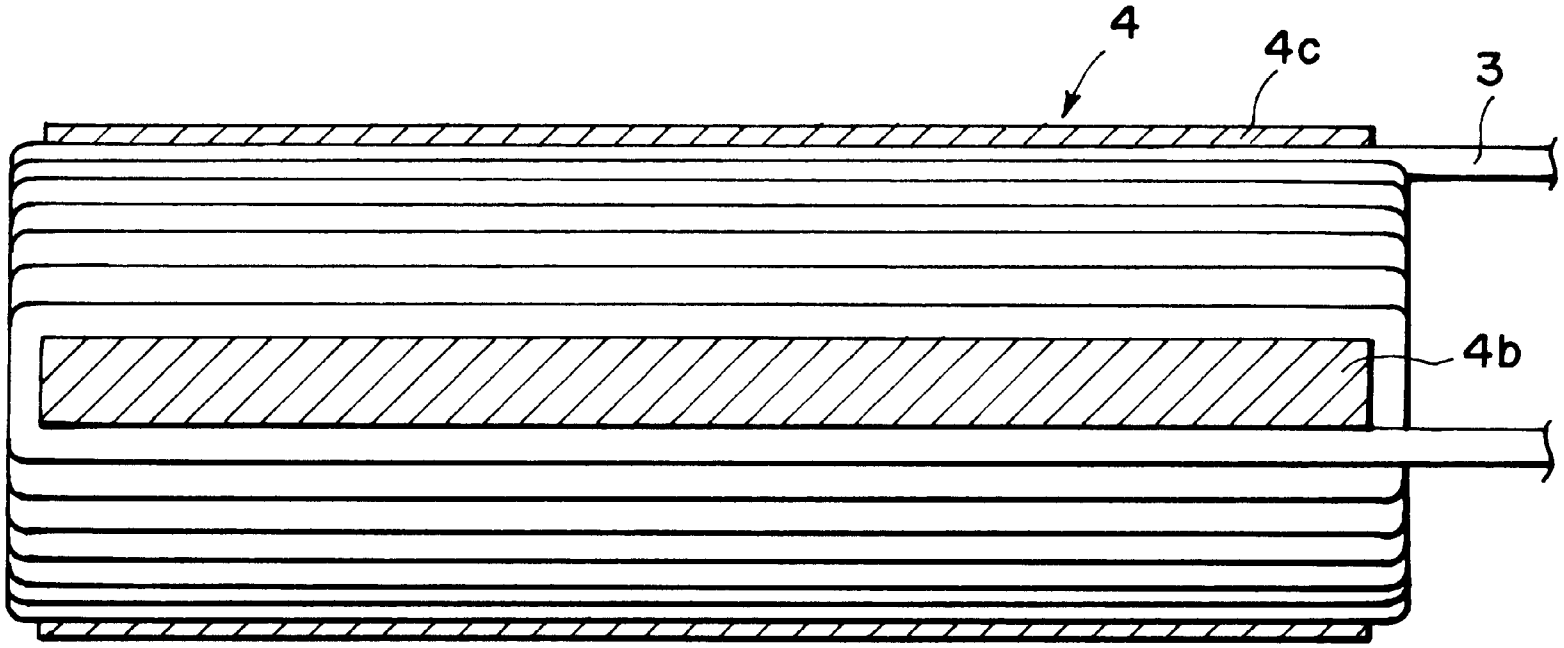
FIG. 5 shows a coil around the magnetic core.

FIG. 5 is a view of the magnetic core 4 with the coil 3 wound therearound as seen from the nip, the coil 3 is such that one bundle extends continuously in the longitudinal direction of the magnetic core 4.

The excitation coil 3 is disposed along the inner surface of the film so that it is as close as possible to the fixing film 1, and the magnetic core 4 is disposed such that excitation coil 3 is in close contact to film inner surface so as to fill the space. In this example, the distance between the excitation coil 3 and the fixing film 1 is 0.2 mm–0.5 mm, and the distance between the magnetic core 4 and the excitation coil 3 is 0–0.5 mm.

The pressing roller 5 which is a back-up member comprises a core metal 5*a* and a heat resistive elastic material 5*b* of silicone rubber, fluorine rubber, fluorine resin material or the like, coated on the core metal. As shown in FIGS. 2 and 3, above the pressing roller 5, there is provided a heating means unit including the fixing film 1, the film guiding member 2, the excitation coil 3, the magnetic core 4, a rigid stay 6 for pressing, flange members 7*a*, 7*b*. Between the opposite ends of the rigid stay 6 and the spring receptor members 8*a*, 8*b* of the frame, pressing springs 9*a*, 9*b* are disposed compressed to urge the stay 6 downward. By doing so, the lower surface of the film guiding member 2 and the upper surface of the pressing roller 5 are urged toward each other with the fixing film 1 therebetween to form a fixing nip N of a predetermined width.

The pressing roller 5 is rotated in the counterclockwise direction indicated by the arrow by driving means M. The fixing film 1 is driven by the pressing roller 5 through the frictional force between the pressing roller 5 and the outer surface of the fixing film 1, so that fixing film 1 rotates around the film guiding member 2 at a peripheral speed substantially corresponding to the rotational speed of the pressing roller 5 in the clockwise direction indicated by the arrow while the inner surface thereof is in sliding and close contact with the lower surface of the film guiding member 2 at the fixing nip N.

The film 1 is loosely extended or fitted around the guiding member 2, and a part of the film 1 is tension free during the driving period.

The heating principle at the fixing nip N will be described.

The excitation coil 3 is supplied with alternating current of 20 kHz–500 kHz from the excitation circuit(unshown) by which alternating magnetic fluxes are generated The alternating magnetic fluxes generate eddy currents in the heat generation layer 1*a* of the fixing film 1, and the eddy currents generate Joule heat through the specific resistance of the heat generation layer 1*a*. The heat thus generated heats the unfixed toner image t on the recording material P and the recording material P which is being fed through the fixing nip N, through the elastic layer 1*b* and the parting layer 1*c*.

Figure 6:
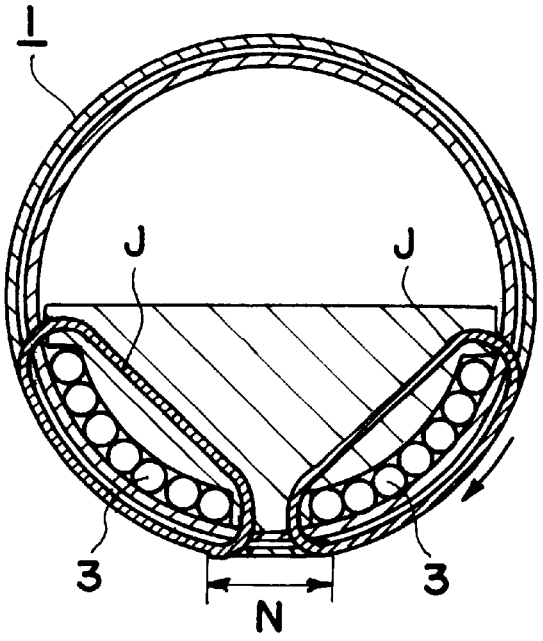
FIG. 6 shows a magnetic flux distribution in the embodiment of the present invention.
Figure 7:
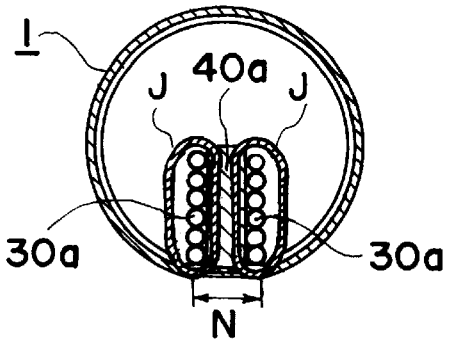
FIGS. 7(*a*)–(*c*) show a magnetic flux distribution in a comparison example.
Figure 7:
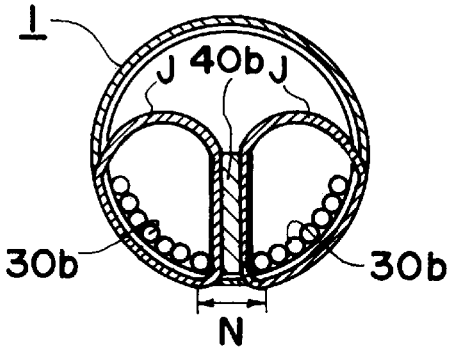
Figure 7:
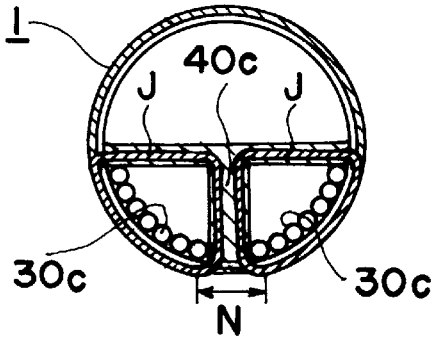

FIG. 6 shows a magnetic flux distribution in a cross-section of the heat-fixing device of the present embodiment. FIG. 7 shows comparison examples wherein (a) shows a magnetic flux distribution of comparison example (1) system which comprises a magnetic core 40*a* having an I-shaped cross-section, an excitation coil 30*a* therearound which is spaced away from the surface of the fixing film 1; (b) shows a magnetic flux distribution of comparison example (2) system which comprises a magnetic core 40*b* having an I-shaped cross-section and an excitation coil 30*b* disposed along the fixing film 1; and (c) shows a magnetic flux distribution of comparison example (3) system which comprises a magnetic core 40*c* having a T-shaped cross-section and an excitation coil 30*b* disposed along the fixing film 1. In FIG. 7, the lines indicated by J indicate a main magnetic flux.

In the case of comparison example 1 (FIG. 7, (*a*)), wherein the excitation coil 30*a* is disposed away from the surface of the fixing film 1, a small number of magnetic fluxes J pass through the fixing film 1, and in the case of comparison example 2 (FIG. 7 (*b*)), wherein the excitation coil 30*b* is disposed along the surface of the fixing film 1, the number thereof is large. In comparison example 3 (FIG. 7 (*c*)), wherein the magnetic core 40*c* has the T-shaped cross-section, the magnetic flux path has a sector-shape defined by the fixing film 1 and the T-shaped magnetic core, so that there is no magnetic flux J through the space portion. In the present embodiment, as shown in FIG. 6, the length of the magnetic path through the magnetic core 4 is short.

Figure 8:
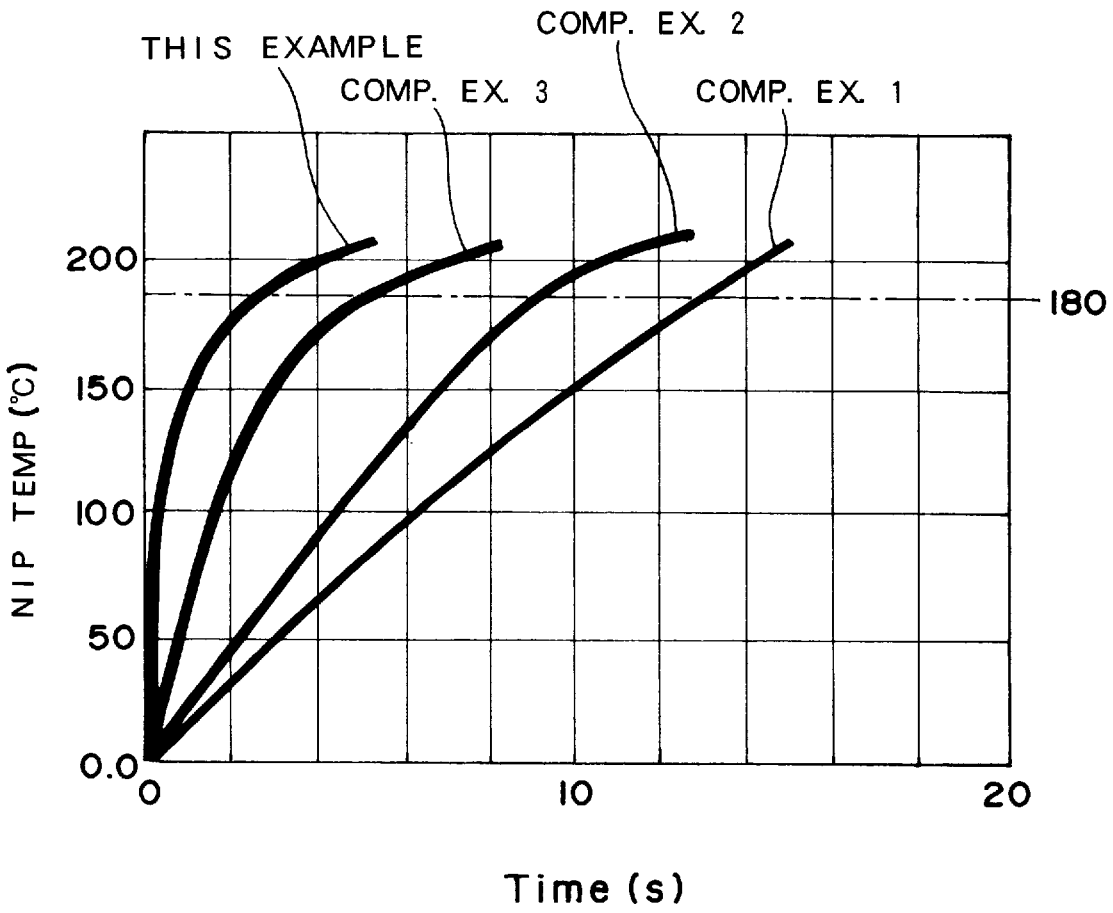
FIG. 8 shows a heating efficiency.

FIG. 8 is a graph showing a temperature of the fixing nip N relative to the time elapsed from the start of the electric power supply in the heat-fixing devices of the comparison examples and the present embodiment. The heating efficiency is represented here by the time required for the nip temperature to reach 180° C. As will be understood from FIG. 8, the heating efficiencies are improved in the order of comparison example 1, comparison example 2 comparison example 3, and that of the present invention is the best.

Figure 9:
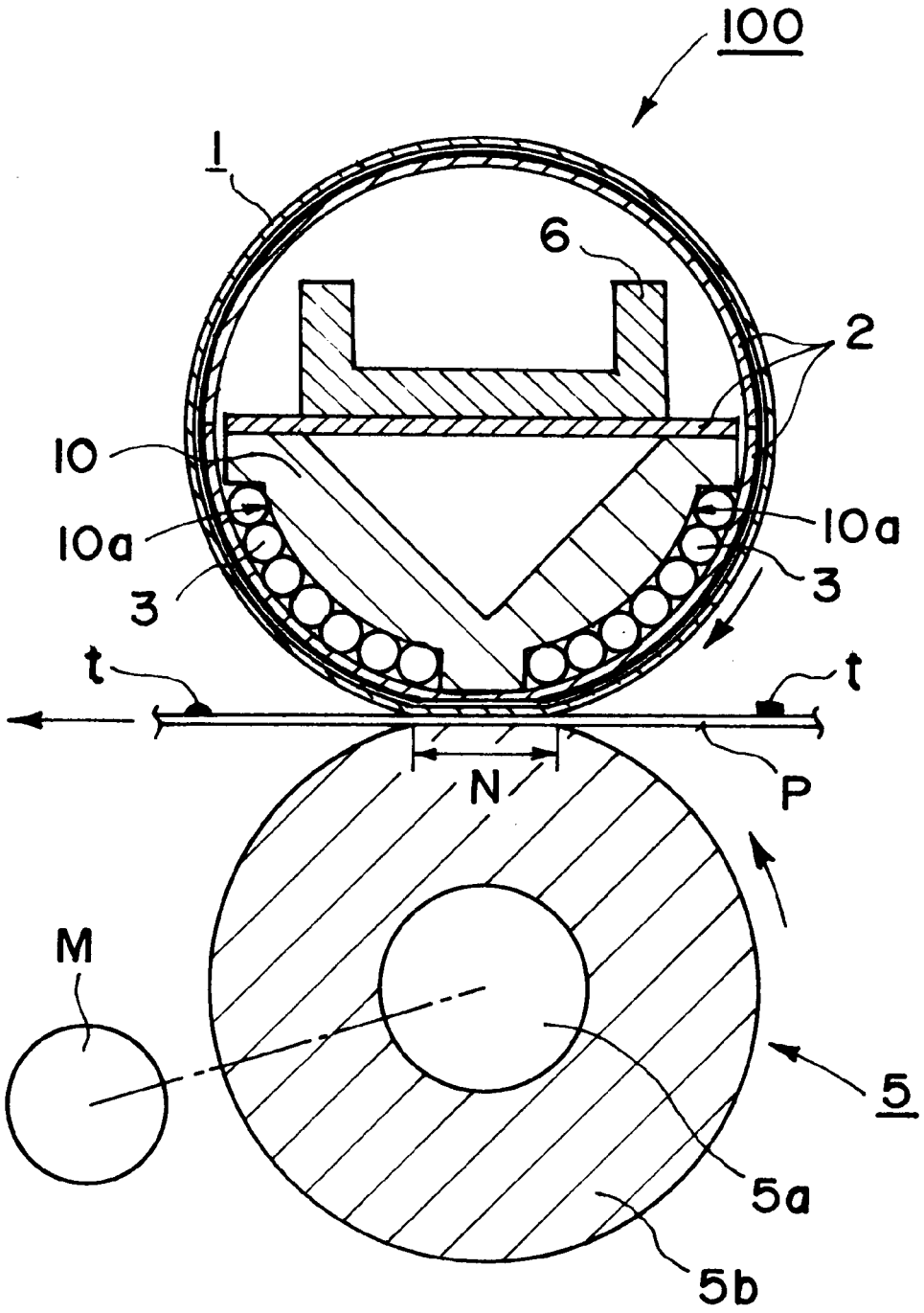
FIGS. 9–15 show an image heating device according to another embodiment of the present invention.

FIG. 9 shows a modified example of this embodiment. The present modified example uses a magnetic core 10 having a V-shaped cross-section of the path in place of the semicircular magnetic core 4. The magnetic core 10 has such a configuration that central portion of the semicircular magnetic core 4 is removed in the form of triangular prism. It may be produced by integral molding, or a semicircular core may be machined. Designated by reference numeral 10*a* is an arc-like recess for maintaining the excitation coil 3 in the configuration extending along the inner surface of the fixing film 1.

By using the configuration of this modified example, the volume of the magnetic core 10 is further reduced, and therefore, the entire thermal capacity can be further reduced, so that rising time of the heat-fixing device can be further shortened, and the efficiency can be further improved. As another modification of the magnetic core 10, the central portion of the semicircular magnetic core 4 may be removed in the form of a substantially semi-columnar shape into an U-shape. This can provide the same advantageous effects.

Figure 10:
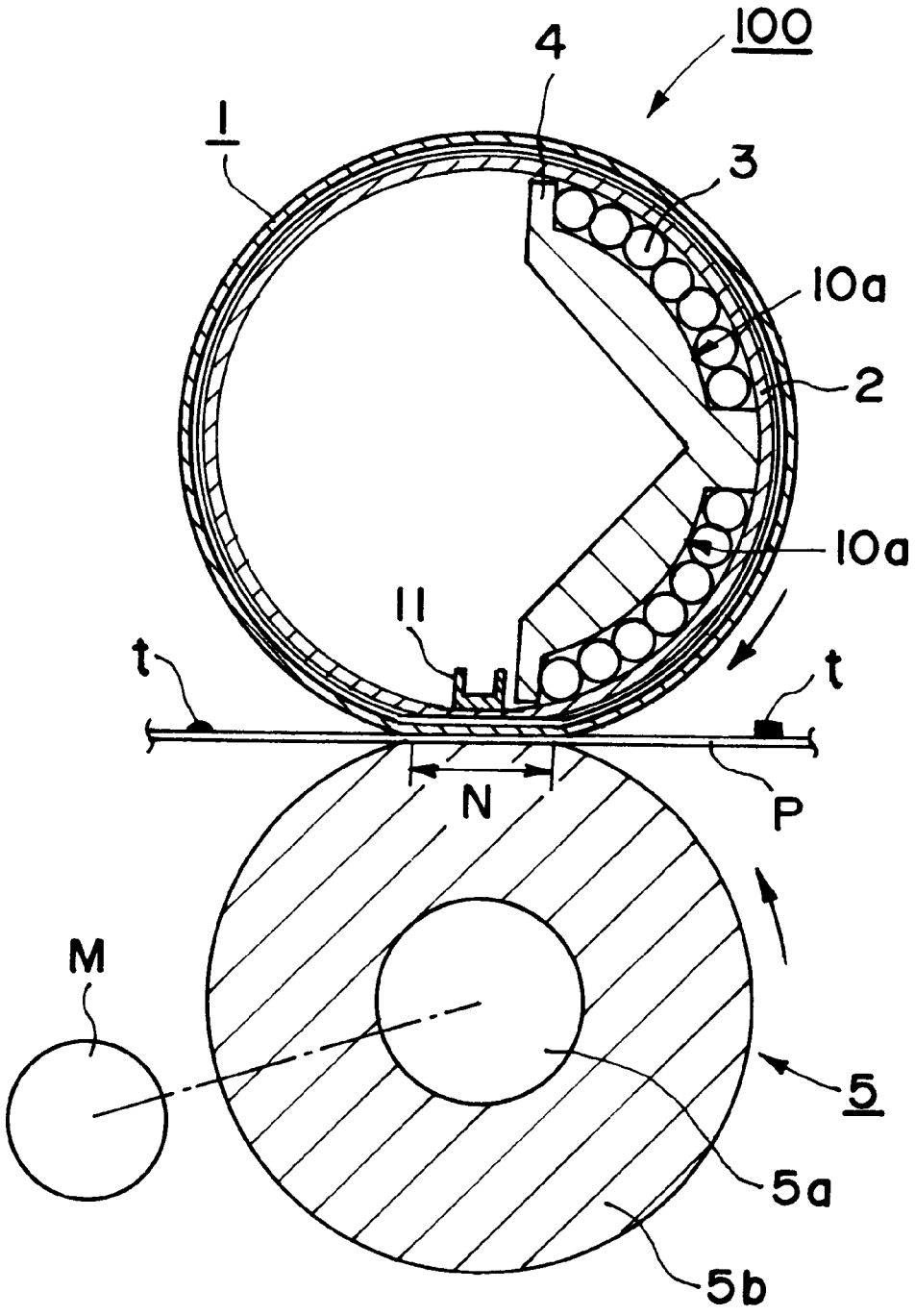

FIG. 10 shows another modified example, wherein the magnetic core 10 and the coil unit(excitation coil 3) shown in FIG. 9 are rotated through approx 90° toward upstream of the fixing film 1, so that pressing stay 11 is disposed closer to the pressing roller 5. The present modified example is suitable to the case where a higher pressing force is desired. More particularly, since the magnetic core 10 is disposed upstream of the fixing nip N, the magnetic core 10 is not present in the pressing region(fixing nip N), and therefore, the magnetic core 10 is not directly subjected to any load so that pressure can be increased without using a special guiding member for protecting the magnetic core 10. If, however, a guiding member or the like is used, the strength required by the pressing member is sufficient even if the thickness of the guiding member is small, the fixing film 1 and the excitation coil 3 can be disposed closer to each other by reducing the thickness of the guiding member, thus increasing the fixing efficiency.

The fixing property was confirmed as being good with the heating apparatus of this embodiment operated at a high speed.

According to this embodiment, the magnetic path of the magnetic flux J formed through the magnetic core 4, excitation coil 3 and the fixing film 1, more particularly, the magnetic path of the magnetic flux J through the magnetic core 4 is shortest, so that heating efficiency of the fixing film 1 is improved. Accordingly, the electric power supply can be effectively utilized, thus permitting electric power saving, and in addition, sufficient fixing property can be assured even if the operational speed of the heat-fixing device is increased.

When the semicircular magnetic core 4, V-shaped or or U-shaped magnetic core 10 is used, the thermal capacity of the entire core can be reduced, so that rising time of the or apparatus can be shortened, and therefore, the operational efficiency is increased. Particularly, when the use is made with the V-shape or U-shape of the magnetic core 10, the volume of the magnetic core is smaller than the semicircular magnetic core 4, so that entire thermal capacity can be reduced, and therefore, the rising time of the heat-fixing device can be shortened, and the efficiency is increased.

Since the excitation coil 3 is extended continuously over the width namely in the direction perpendicular to the movement direction of the fixing film 1, the magnetic flux is uniform in the lateral direction of the fixing film 1 (longitudinal direction of the excitation coil 3) so that heat generation distribution is uniform.

Figure 11:
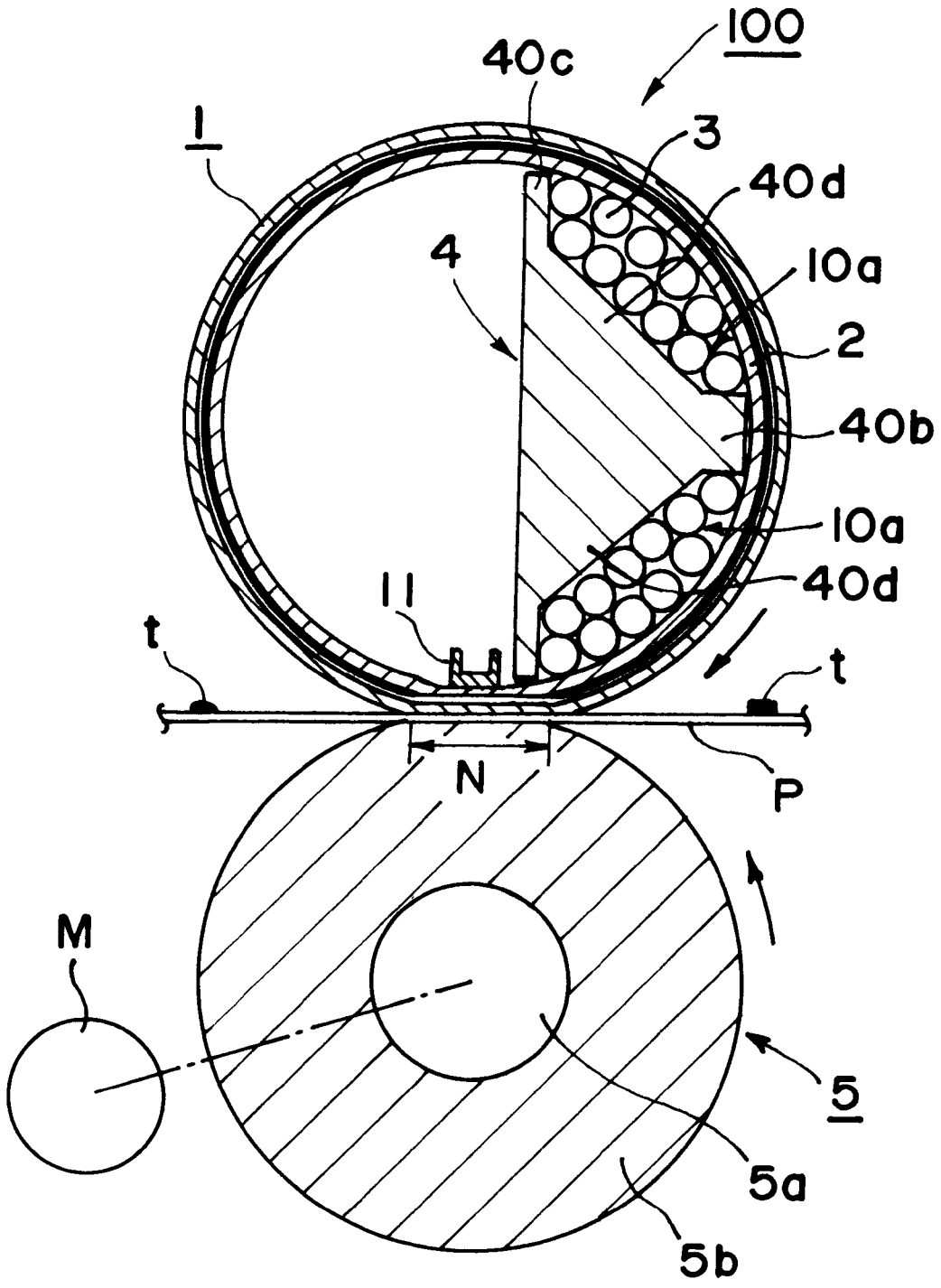

In the embodiments described in the foregoing, the outer shape of the third magnetic portion 40*d* of the magnetic core is arcuated. FIG. 11 shows another embodiment, wherein the portion is linear(flat surface).

In FIG. 11, the third magnetic portion 40*d* between a first magnetic portion 40*b* and a second magnetic portion 40*c* of the magnetic core 4, is in the form of a linear flat surface, and is close to the film 1 through the excitation coil 3.

In this embodiment, the magnetic path length can be reduced.

A further embodiment will be described, wherein the support of the coil is stabilized.

Figure 12:
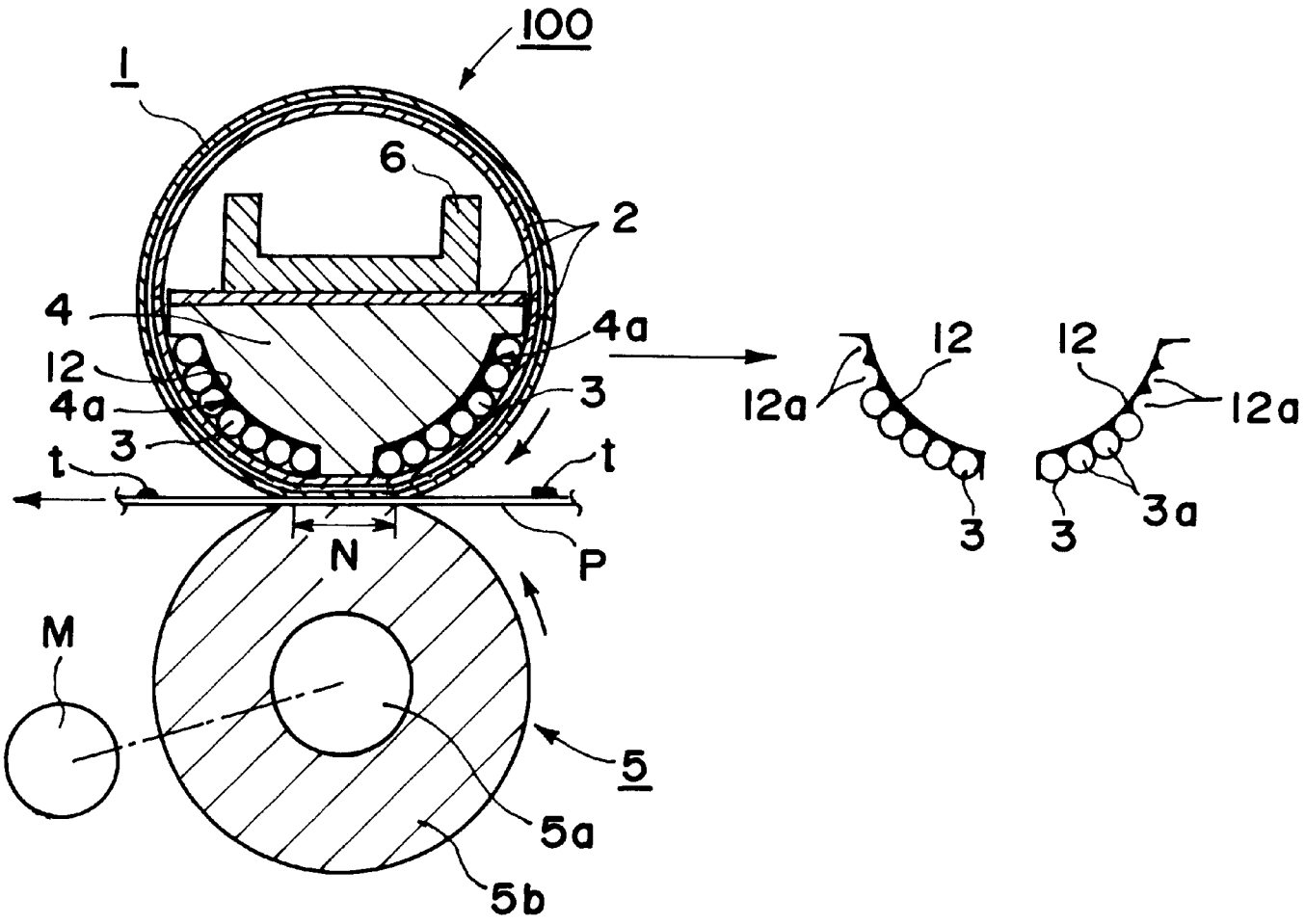

FIG. 12 is a schematic cross-sectional view of a major part of a heat-fixing device according to this embodiment.

In this embodiment, in order to stabilize the coil configuration of the excitation coil 3 in the heat-fixing device 100, a bobbin 12 as a coil holding member is provided in the magnetic core 4. The same reference numerals as in the Figure are assigned to the elements having the corresponding functions, and detailed descriptions thereof are omitted for simplicity.

The bobbin 12 is of insulative and heat-resistive material such as phenolic resin, polyimide resin material, polyamide resin material or the like having a thickness of 0.5 mm, and the excitation coil 3 is stably supported along the surface of the fixing film 1, and it supports the magnetic core 4 having the semicircular cross-section therein. The excitation coil 3 side surface of the bobbin 12 is provided with a plurality of V-shaped or U-shaped longitudinal grooves 12*a* having a width of 2 mm and a depth of 1 mm to assist winding (set line 3*a*) of the excitation coil 3. The groove 12*a* may be a concave surface having a diameter which is the same as the diameter of the coil 3*a*, or may be provided by projections having a predetermined clearance.

With this structure, the coil configuration and the coil property can be stabilized when the excitation coil 3 is manufactured by winding the coil 3*a* around the magnetic core 4. More particularly, by winding the line 3*a* of the excitation coil 3 such that it is within the groove 12*a* corresponding to the coil 3*a* at the bobbin surface side, the coil 3*a* is prevented from deviating, and the constant clearances and density of the excitation coil 3 is assuredly provided along the surface of the fixing film 1, and therefore, the coil property is stabilized. Using the bobbin 12 is effective to prevent the coil coating damage which may occur when the excitation coil 3 is directly wound around the magnetic core 4.

Figure 13:
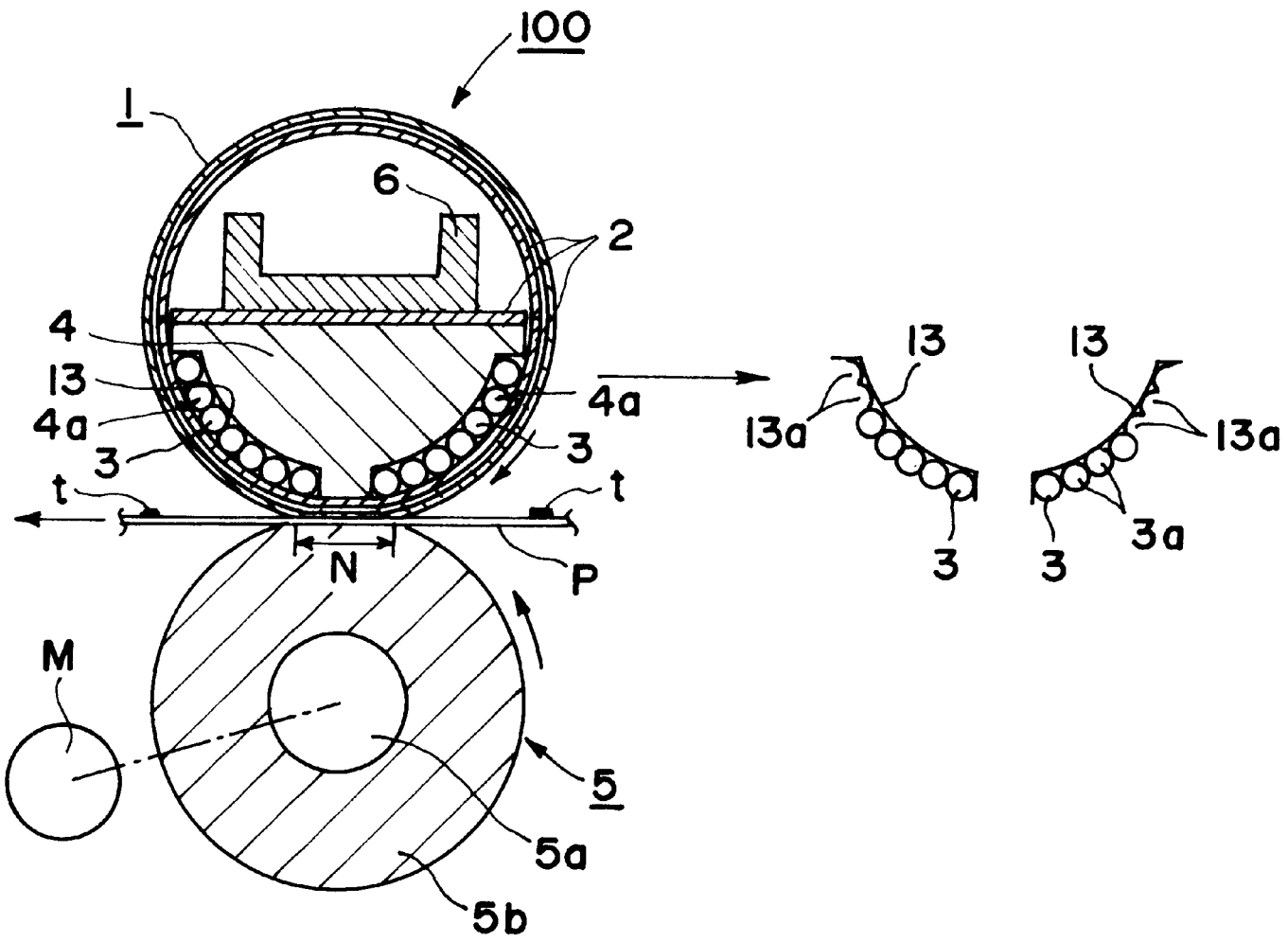

FIG. 13 shows a modified example wherein the use is made with a bobbin 13 of material(magnetic member) which is the same as that of the magnetic core 4 such as ferrite or permalloy. The bobbin 13, similarly to the bobbin 12 described above, is provided with a plurality of grooves 13*a* or projections (unshown) on the surface thereof at the excitation coil 3 side to assist the winding of the line 3*a* for the excitation coil 3. In the present modified example, the bobbin 13 functions also as a magnetic core, so that magnetic core 4, the excitation coil 3 and the fixing film 1 can be arranged in a compact manner, so that function of the heat-fixing device is more efficient. Additionally, by the use of the bobbin 13, the coil coating damage which may occur when the excitation coil 3 is wound directly around the magnetic core 4 can be prevented.

Figure 14:
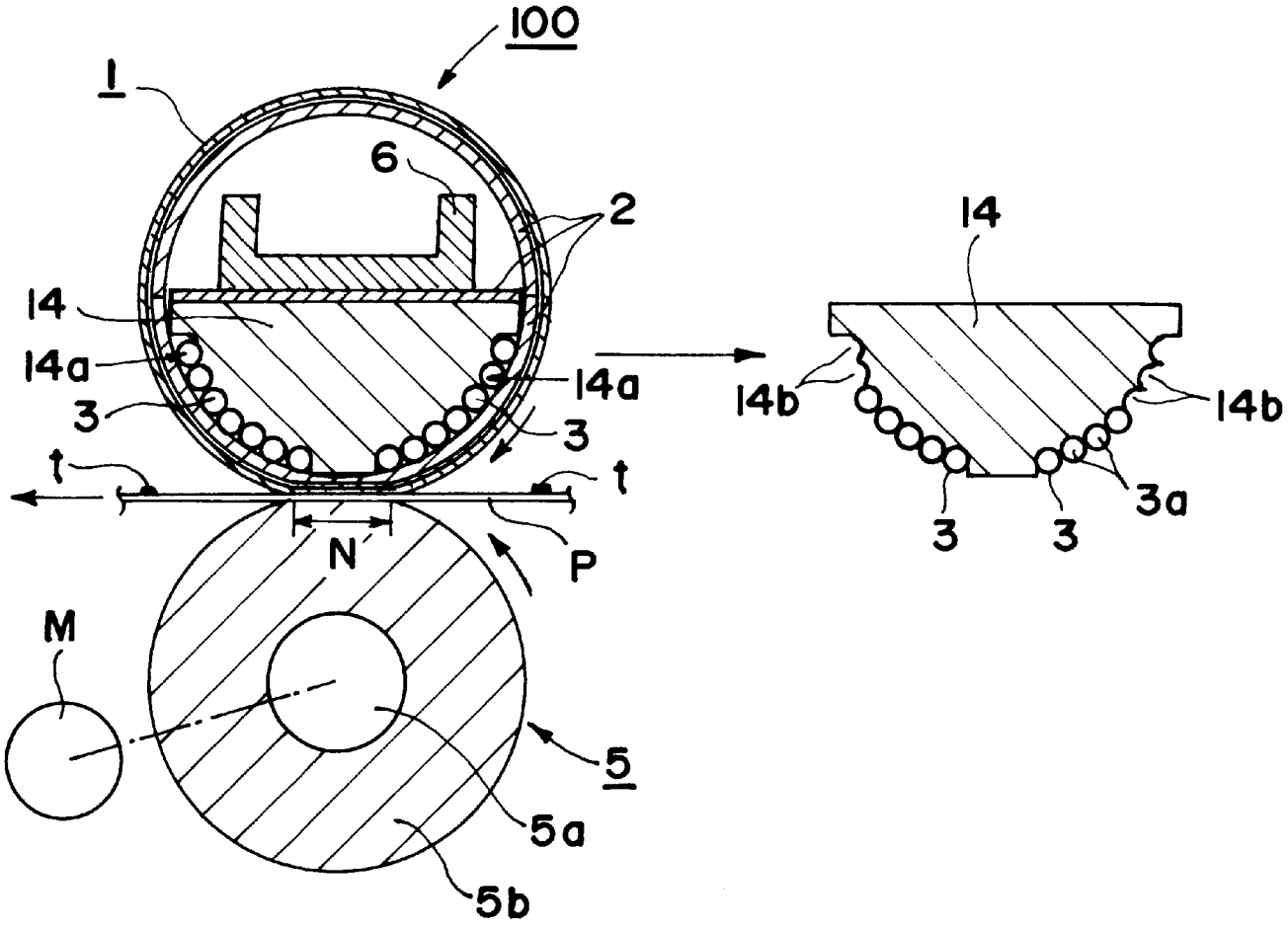

FIG. 14 shows another example, wherein the excitation coil 3 is directly supported on a magnetic core 14. The magnetic core 14 of the present modified example has an arc-like recess 14*a* for maintaining the excitation coil 3 in the configuration along the inner surface of the fixing film 1, and the fixing film 1 side surface of the recess 14*a* is a concave surface having a plurality of projections (unshown) or grooves 14*b* having a diameter which is the same as the diameter of the line 3*a* of the excitation coil 3. The surface is coated with insulative resin material such as polyimide resin material. With this structure, the coil configuration of the excitation coil 3 is stabilized, and the bobbin 12 or 13 is not necessary, thus simplifying the structure. The coating of the insulative resin material such as the polyimide resin material of the surface of the magnetic core 14 mainly functions to protect the coating of the coil 3*a* of the excitation coil 3 from friction with the magnetic core 14, and when the friction or wearing is not a problem, the insulation coating can be omitted.

As described in the foregoing, the operativity when the excitation coil 3 is wound along the fixing film 1 can be improved, and the coil configuration and the coil property of the excitation coil 3 can be stabilized.

Using the bobbin 12 or 13 is effective to prevent the coil coating damage which may occur when the excitation coil 3 is directly wound around the magnetic core 4.

Figure 15:
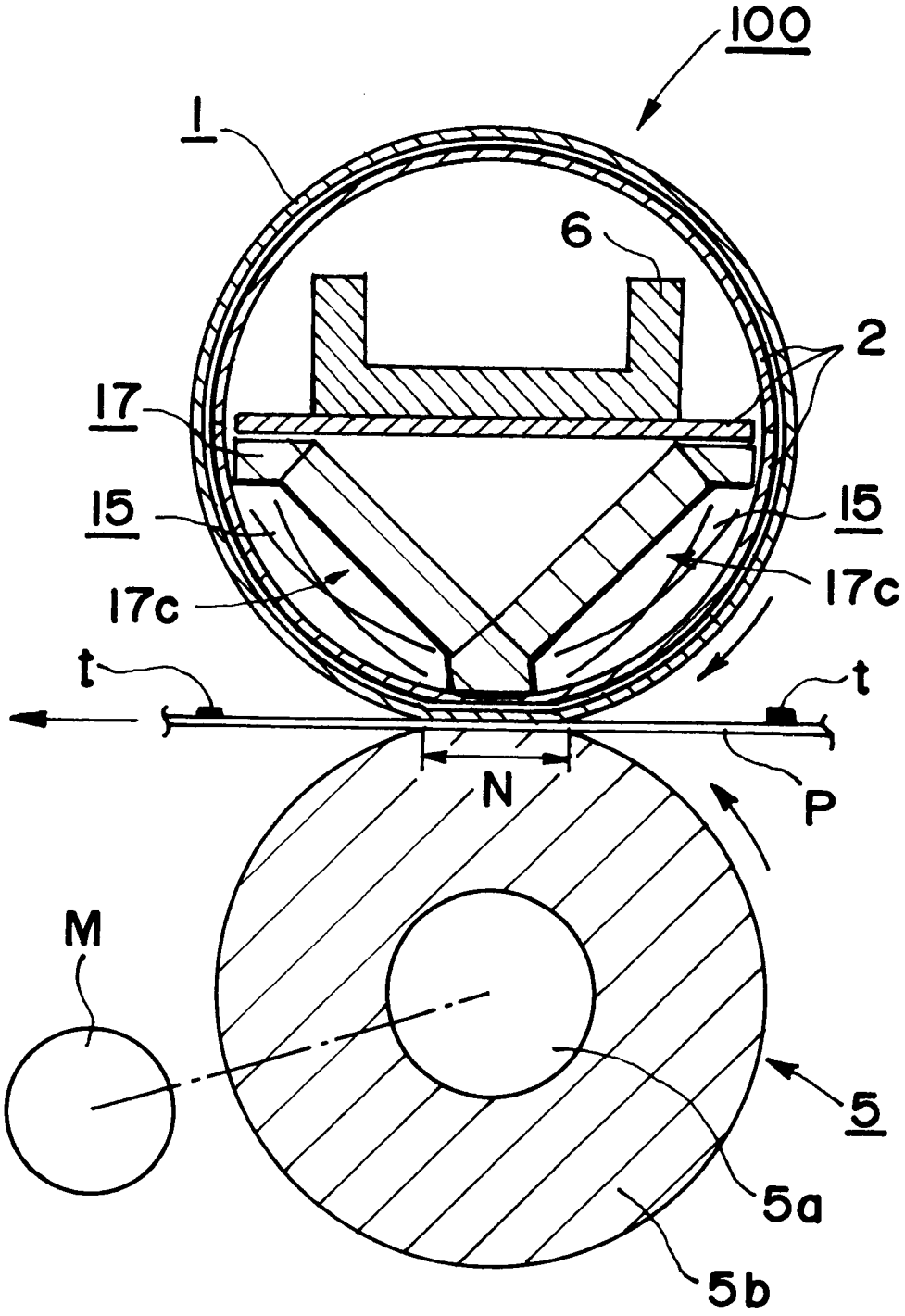

FIG. 15 is a schematic cross-sectional view of a major part of a heat-fixing device according to this embodiment. FIG. 14 illustrates a molding method of the coil member according to an embodiment of the present invention. FIG. 15 is an illustration of a magnetic core usable with the present invention.

Figure 16:
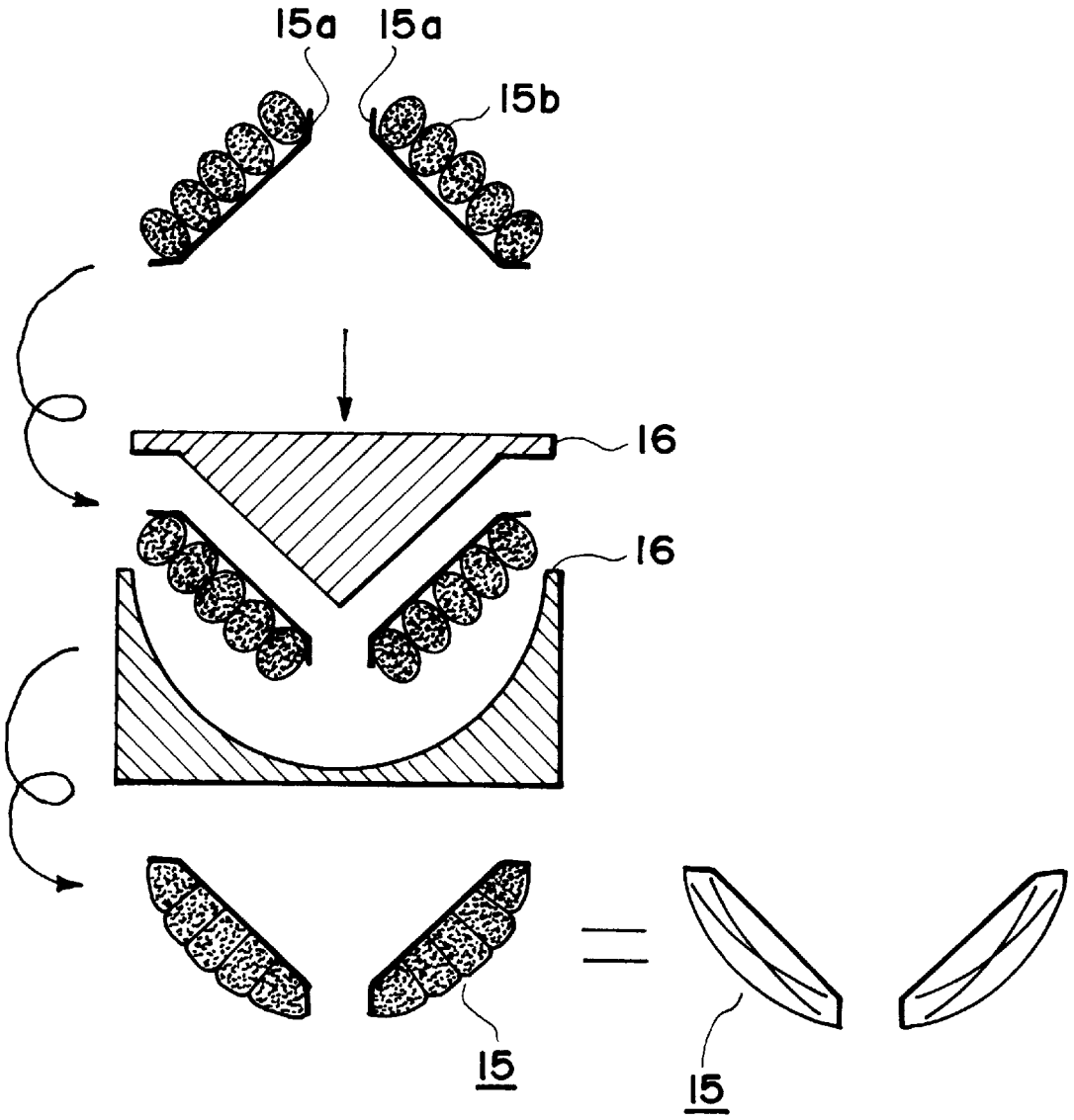
FIG. 16 is an illustration of a coil compression.

The coil member 15 used in the heat-fixing device 100, as shown in FIG. 16, the coil lead or line 15*b* of the excitation coil 3 is supported on the bobbin 15*a* as the supporting member having a dish-like cross-section, and is pressed by a press device 16 and is integrally molded such that surface of the coil(line ring) is in conformity with the surface of the fixing film 1.

Figure 17:
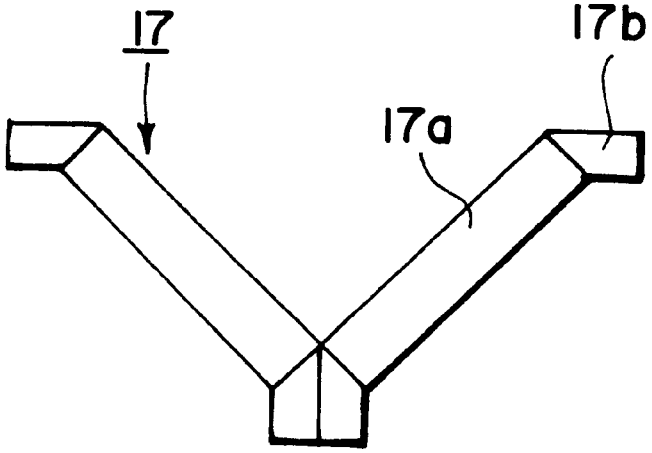
FIGS. 17(*a*) and (*b*) are illustrations of a magnetic core
Figure 17:
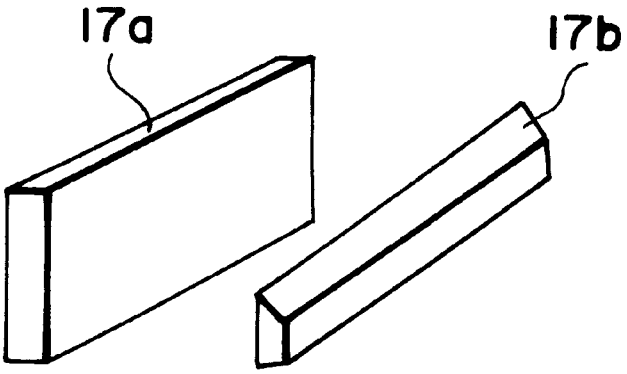

As shown in FIGS. 17, (*a*) and (*b*), the magnetic core 17 has a V-shape by combination of two prisms 17*a* and 17*b* which are magnetic members, and is placed on the coil member 15 (FIG. 15). In FIG. 15, designated by reference numeral 17*c* is an arc-like recess for maintaining the shape of the coil member 15 in the configuration extending along the inner surface of the fixing film 1.

As described in the foregoing, the coil member 15 is in the form of an integral coil unit comprising the bobbin 15*a* and the excitation coil 3 (coil 15*b*), so that coil configuration and the coil property is stabilized, and the winding operation of the excitation coil 3 around the magnetic core 4 or the bobbin 12, 13 as the coil holding member can be omitted, and therefore, the operativity is improved.

Since the magnetic core 17 is constituted by the combination of the two magnetic prisms 17*a*, 17*b*, the configuration of the magnetic core per se is simple, and therefore, the cost reduction of the magnetic core is accomplished.

Additionally, since the magnetic core 17 is disposed on the coil member 15, similarly to the foregoing embodiment, the magnetic path of the magnetic flux formed by the fixing film 1, the coil member 15 and the magnetic core 17, more particularly, the magnetic path of the magnetic flux through the magnetic core 17, is shortened, so that heating efficiency of the fixing film 1 is improved. So, even when the operation speed of the heat-fixing device is raised, the sufficient fixing property can be assured, and therefore, the fixing efficiency is enhanced.

In the foregoing embodiments, the stay 6 is urged downward by the pressing springs 9*a*, 9*b* disposed between the opposite ends of the rigid stay 6 and the spring receptor members 8*a*, 8*b* of the frame to form the fixing nip N of a predetermined width sandwiching the fixing film 1 by the upper surface of the pressing roller 5 and the lower surface of film guiding member 2. In an alternative, the opposite ends of the rigid stay 6 is fixed, and the pressing roller 5 may be urged upward by an urging member(pressing spring) to form the fixing nip N of a predetermined width sandwiching the fixing film 1 by the upper surface of the pressing roller 5 and the lower surface of the film guiding member 2. In a further alternative, both of the rigid stay 6 and the film guiding member 2 may be urged to each other by urging members (pressing springs) to form a fixing nip N of a predetermined width sandwiching the fixing film 1 by the upper surface of the pressing roller 5 and the lower surface of the film guiding member 2.

In the foregoing embodiments, the pressing member is not limited to a roller member, but may be a rotatable belt type or the like. The pressing member may be a pressing rotatable member driven by an electromagnetic induction heat generation property member (fixing film 1) which is a rotatable member. In order to supply the thermal energy also from the pressing member to the recording material P, the pressing member b may be provided with heat generating means such as electromagnetic induction heating to heat to a predetermined temperature and to control the temperature.

As an alternative of the foregoing embodiments, the fixing film 1 as the electromagnetic induction heat generation property member may be extended and stretched around a plurality of rotatable members (rollers) including the magnetic field generating means(the excitation coil and the magnetic core) and may be rotated by driving means M. As a further alternative, the fixing film 1 as the electromagnetic induction heat generation property member may be in the form of A non-endless roll of long film, which is supplied to the magnetic field generating means(excitation coil and magnetic field generating means).

In the embodiment and modification shown in FIGS. 12, 13, 14, V-shaped magnetic core 10 as shown in FIG. 9 or U-shaped magnetic core(unshown) or the magnetic core 17 of FIG. 17 may be used in place of the magnetic core 4, 14. In the embodiment Of FIG. 1, the coil member 15 as shown in FIG. 17 may be used in place of the excitation coil 3. The groove or the projections for excitation coil 3 may be formed on the excitation coil 3 side surface of the V-shape magnetic core 10 or the U-shape magnetic core(unshown) in the embodiment and the modified example of Figure 1.

In the embodiments of FIGS. 12, 13 and 14, the magnetic field generating means constituted by the magnetic core 4, 14 and the excitation coil 3 may be disposed at the upstream of the fixing film 1 with rotation of 90°, as shown in FIG. 10. In the embodiment of FIG. 15, the magnetic core 17 and the coil member 15 may be disposed at the upstream of the fixing film 1 with rotation of 90°, as shown in FIG. 10.

The heating apparatus of the present invention is not limited to an image fixing device, but is applicable for an image heating device for improving the surface property such as gloss by heating the sheet carrying an image, for an image heating device for temporary fixing, for a heat drying apparatus for a material, for a heat lamination apparatus, and for other means for heating a material. The pressing member may directly or indirectly close-contact the material to be heated to the electromagnetic induction heat generation property member(fixing film 1).

The image forming apparatus of the embodiments have been described as a four-color image forming apparatus, but may be used fro a single pulse multi-color image forming apparatus.

The fixing film 1 having the electromagnetic induction heat generation property may be free of the elastic layer in the case of heating or fixing the monochromatic image or single pulse multi-color image. The heat generation layer may contain metal filler material. The heat generation layer may be a single.

The image formation principle and system of the image forming apparatus are not limited to those using the electrophotographic process, but may be a transfer type or direct type electrostatic recording process, or the magnetic recording process type.

While the invention has been described with reference to the structures disclosed herein, it is not confined to the details set forth and this application is intended to cover such modifications or changes as may come within the purposes of the improvements or the scope of the following claims.

What is claimed is:

1. An image heating apparatus comprising:

a movable member including an electroconductive layer;

an excitation coil for generating magnetic flux;

wherein the magnetic flux generated by the excitation coil generates an eddy current which in turn generates heat in said movable member to heat an image on a recording material; and a magnetic member for guiding the magnetic flux;

wherein said magnetic member is elongated in a direction perpendicular to a movement direction of said movable member, and said excitation coil is extended in a longitudinal direction of said magnetic member;

wherein said magnetic member includes a first magnetic portion adjacent to said movable member, a second magnetic portion, and a third magnetic portion between said first magnetic portion and said second magnetic portion and adjacent to said movable member with said excitation coil therebetween, as seen in the longitudinal direction;

a surface of said third magnetic portion closer to said excitation coil is curved to be convex toward said movable member.

2. An apparatus according to claim 1, further comprising a back up member for contacting to said movable member and forming a contact portion therewith, and said first magnetic portion is opposed to said contact portion.

3. An apparatus according to claim 2, wherein said second magnetic portion is disposed at each of upstream and downstream sides of said first magnetic portion.

4. An apparatus according to claim 2, wherein a recording material carrying an image is passed through said contact portion.

5. An apparatus according to claim 1, wherein said magnetic member has a V-shaped cross-section.

6. An apparatus according to claim 1, wherein said magnetic member has an U-shaped cross-section.

7. An apparatus according to claim 1, further comprising a back up member for contacting to said movable member and forming a contact portion therewith, and an entirety of said magnetic member is disposed upstream of said contact portion with respect to the movement direction of said movable member.

8. An apparatus according to claim 1, further comprising a supporting member for supporting said excitation coil adjacent said magnetic member.

9. An apparatus according to claim 8, wherein said supporting member is provided with a groove in a surface thereof contacting to said excitation coil.

10. An apparatus according to claim 8, wherein supporting member is of magnetic material.

11. An apparatus according to claim 8, wherein said supporting member and said excitation coil are integrally formed into a unit.

12. An apparatus according to claim 1, wherein said third magnetic portion is provided with a groove in a surface contacting to said excitation coil.

13. An apparatus according to claim 1, wherein said movable member is in the form of an endless film.

14. An apparatus according to claim 13, further comprising a supporting member, inside said film, for supporting said magnetic member and said excitation coil and for guiding movement of said film.

15. An apparatus according to claim 14, further comprising a back-up member for forming a nip with said supporting member with a film therebetween, and a recording material carrying an unfixed image is passed through said nip to heat and fix the unfixed image on the recording material.

16. An image heating apparatus comprising:

a movable member including an electroconductive layer;

an excitation coil for generating magnetic flux;

wherein the magnetic flux generated by the excitation coil generates an eddy current which in turn generates heat in said movable member to heat an image on a recording material; and a magnetic member for guiding the magnetic flux;

wherein said magnetic member is elongated in a direction perpendicular to a movement direction of said movable member, and said excitation coil is extended in a longitudinal direction of said magnetic member;

wherein said magnetic member includes a first magnetic portion adjacent to said movable member, a second magnetic portion, and a third magnetic portion between said first magnetic portion and said second magnetic portion and adjacent to said movable member with said excitation coil therebetween, as seen in the longitudinal direction;

a back up member for contacting to said movable member and forming a contact portion therewith;

wherein an entirety of said magnetic member is disposed substantially upstream of said contact portion with respect to the movement direction of said movable member.

17. An apparatus according to claim 16, wherein said third magnetic portion has a curved surface adjacent said excitation coil.

18. An apparatus according to claim 16, wherein said third magnetic portion has a flat surface adjacent said excitation coil.

19. An apparatus according to claim 16, wherein a recording material carrying an image is passed through said contact portion.

20. An apparatus according to claim 16, wherein said magnetic member has a V-shaped cross-section.

21. An apparatus according to claim 16, wherein said magnetic member has a U-shaped cross-section.

22. An apparatus according to claim 16, further comprising a supporting member for supporting said excitation coil adjacent said magnetic member.

23. An apparatus according to claim 22, wherein said supporting member is provided with a groove in a surface thereof contacting to said excitation coil.

24. An apparatus according to claim 22, wherein the supporting member is of magnetic material.

25. An apparatus according to claim 22, wherein said supporting member and said excitation coil are integrally formed into a unit.

26. An apparatus according to claim 16, wherein said third magnetic portion is provided with a groove in a surface contacting to said excitation coil.

27. An apparatus according to claim 16, wherein said movable member is in the form of an endless film.

28. An apparatus according to claim 27, further comprising a supporting member, inside said film, for supporting said magnetic member and said excitation coil and for guiding movement of said film.

29. An apparatus according to claim 28, further comprising a back-up member for forming a nip with said supporting member with a film therebetween, and wherein a recording material carrying an unfixed image is passed through said nip to heat and fix the unfixed image on the recording material.

30. An apparatus according to claim 16, further comprising a pressing stay for applying pressure to said contact portion, and wherein said magnetic member is provided at a position out of a portion between said pressing stay and said contact portion.

* * * * *

UNITED STATES PATENT AND TRADEMARK OFFICE

CERTIFICATE OF CORRECTION

PATENT NO. : 5,970,299

DATED : October 19, 1999

INVENTOR(S): TETSUYA SANO, ET AL.

It is certified that error appears in the above-identified patent and that said Letters Patent is hereby corrected as shown below:

COVER PAGE AT ITEM [56] RC:
Foreign Patent Documents: insert --51-109737 4/1976 Japan--.

COLUMN 2:
Line 6, "device" should read --device that--.

COLUMN 3:
Line 22, "transfer" should read --transferred--.

COLUMN 7:
Line 7, "generated" should read --generated.--.

COLUMN 8:
Line 37, "or" (2nd occurrence) should be deleted; and
Line 39, "or" should be deleted.

COLUMN 10:
Line 57, "is" should read --are--.

UNITED STATES PATENT AND TRADEMARK OFFICE

CERTIFICATE OF CORRECTION

PATENT NO. : 5,970,299

DATED : October 19, 1999

INVENTOR(S): TETSUYA SANO, ET AL.

It is certified that error appears in the above-identified patent and that said Letters Patent is hereby corrected as shown below:

COLUMN 11:

Line 51, "fro" should read --from--.

Signed and Sealed this

Third Day of April, 2001

*Attest:*

Nicholas P. Godici

NICHOLAS P. GODICI

*Attesting Officer*

*Acting Director of the United States Patent and Trademark Office*